United States Patent [19]

Freire Costas

[11] 4,202,286

[45] May 13, 1980

[54] UNIVERSAL THREAD CUTTING DEVICE AND COMPLEMENTARY DEVICES APPLICABLE TO SEWING MACHINES

[75] Inventor: Alfonso Freire Costas, Vigo, Spain

[73] Assignee: Industrias P. Freire, S.A., Bouzas-Vigo, Spain

[21] Appl. No.: 891,844

[22] Filed: Mar. 30, 1978

[51] Int. Cl.[2] ..... D05B 65/02

[52] U.S. Cl. ..... 112/286; 112/294; 112/300; 112/301; 112/254

[58] Field of Search ..... 112/286, 292, 294, 297, 112/300, 301, 254, 255

[56] References Cited

U.S. PATENT DOCUMENTS

| | | | |
|---|---|---|---|
| 1,988,460 | 1/1935 | Pikul | 112/286 |
| 3,354,852 | 11/1967 | Kennedy et al. | 112/286 |
| 3,532,065 | 10/1970 | Marjorio | 112/301 |
| 3,894,502 | 7/1975 | Hager et al. | 112/300 |
| 4,077,342 | 3/1978 | Steckenrider | 112/294 |
| 4,098,208 | 7/1978 | Hedegaard | 112/300 |

FOREIGN PATENT DOCUMENTS

| | | | |
|---|---|---|---|
| 2344720 | 4/1975 | Fed. Rep. of Germany | 112/294 |

*Primary Examiner*—H. Hampton Hunter

*Attorney, Agent, or Firm*—Wenderoth, Lind & Ponack

[57] ABSTRACT

A thread cutting device applicable to sewing machines includes elements connected to a support plate to be installed in the sewing machine at the position therein where the common sliding elements are to be located. The support plate has a screw which acts on a bridge element when the bridge element is pressed against the lower face of a panel of the machine. One of the elements of the thread cutting device has a generally Y-shaped configuration and is provided with an alternating lineal movement, either by means of manual, electro-pneumatic or electromagnetic operation, in directions parallel to that of the sewing of the machine. Such shaped element angularly operates a movable knife against a fixed knife in synchronized cooperation with a thread collecting hook which also has an angular displacement. The arrangement further includes a thread withdrawing device and a thread tension opening device.

17 Claims, 22 Drawing Figures

FIG-4
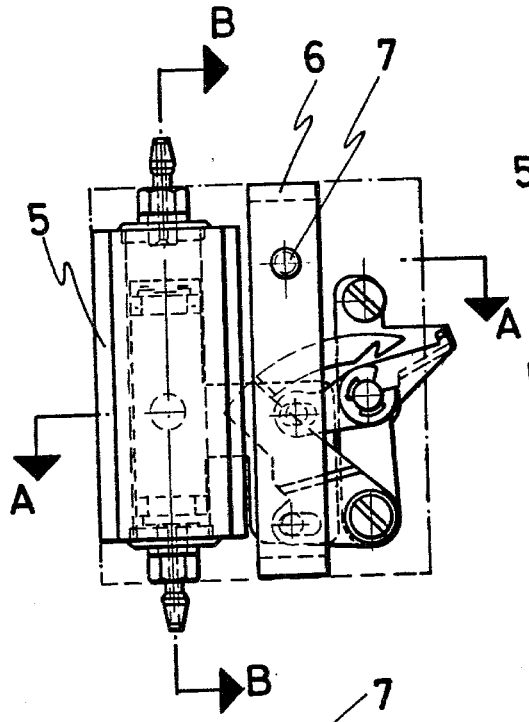
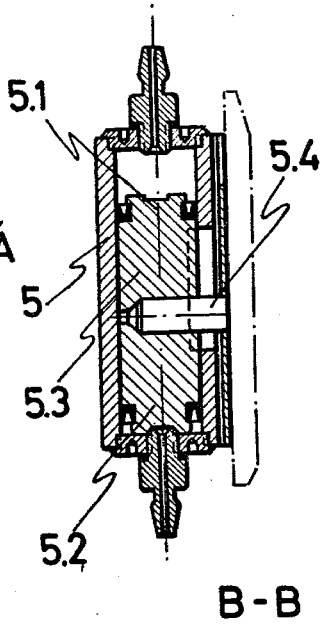
FIG-6
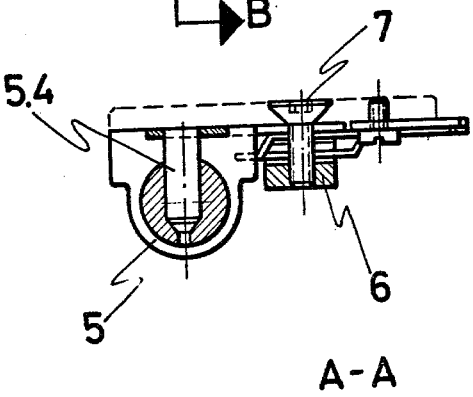
FIG-5

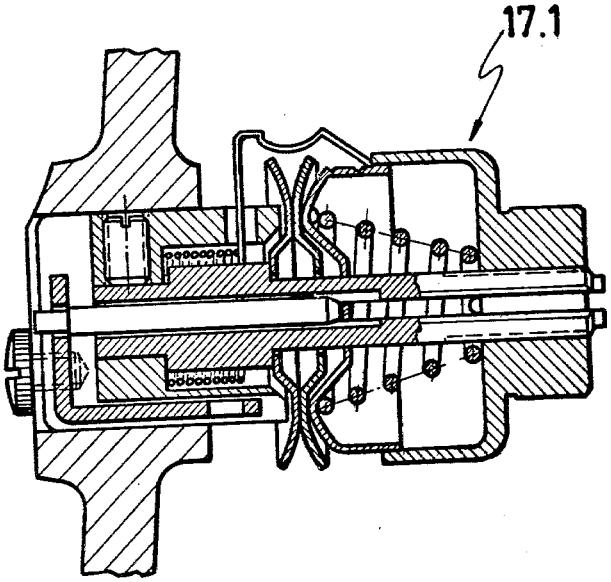
FIG-19
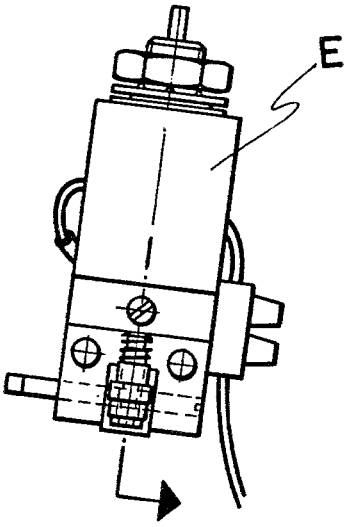
FIG-20.1
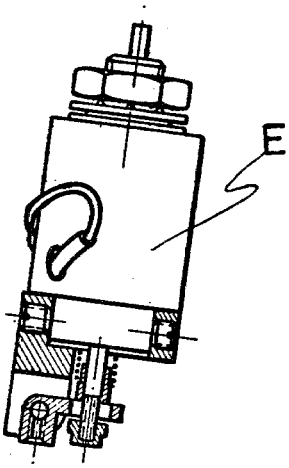
FIG-20.2

UNIVERSAL THREAD CUTTING DEVICE AND COMPLEMENTARY DEVICES APPLICABLE TO SEWING MACHINES

BACKGROUND AND SUMMARY OF THE INVENTION

The present invention relates to a universal thread cutting device and complementary thread withdrawing and tension opening devices applicable to sewing machines.

As a result of the efficiency achieved by the application of thread cutting devices in various industrial sewing processes, such devices have rapidly appeared on the sewing machine market.

The object of the present invention is to provide a novel and improved system of such type having improved capabilities. The system of the invention provides the following features and advantages.

The system can be adapted to the majority of industrial sewing machines existing in the market without the need of complementary adjustments or modifications.

The system can include activation means of various types.

Various devices, such as a thread withdrawing device and a tension opening device, operate in synchronization with a thread cutting device, thereby complementing the sewing and cutting process.

The entire system of the thread cutting device and the thread withdrawing and tension opening devices is automated together with the various sewing elements of the sewing machine.

BRIEF DESCRIPTION OF THE DRAWINGS

Embodiments of the invention will now be described with reference to the accompanying drawings, wherein:

FIG. 4 is a bottom view of the thread cutting device, operable by electro-pneumatic means;

FIGS. 5 and 6 are sections along lines V—V and V–VI respectively of FIG. 4;

FIGS. 17 through 19 are views similar to FIG. 15, but showing still further embodiments of the tension releasing device;

FIGS. 20*a* and 20*b* are enlarged views of an electromagnet operable to activate the tension releasing device of FIG. 19.

DETAILED DESCRIPTION OF THE INVENTION

Figure 7:
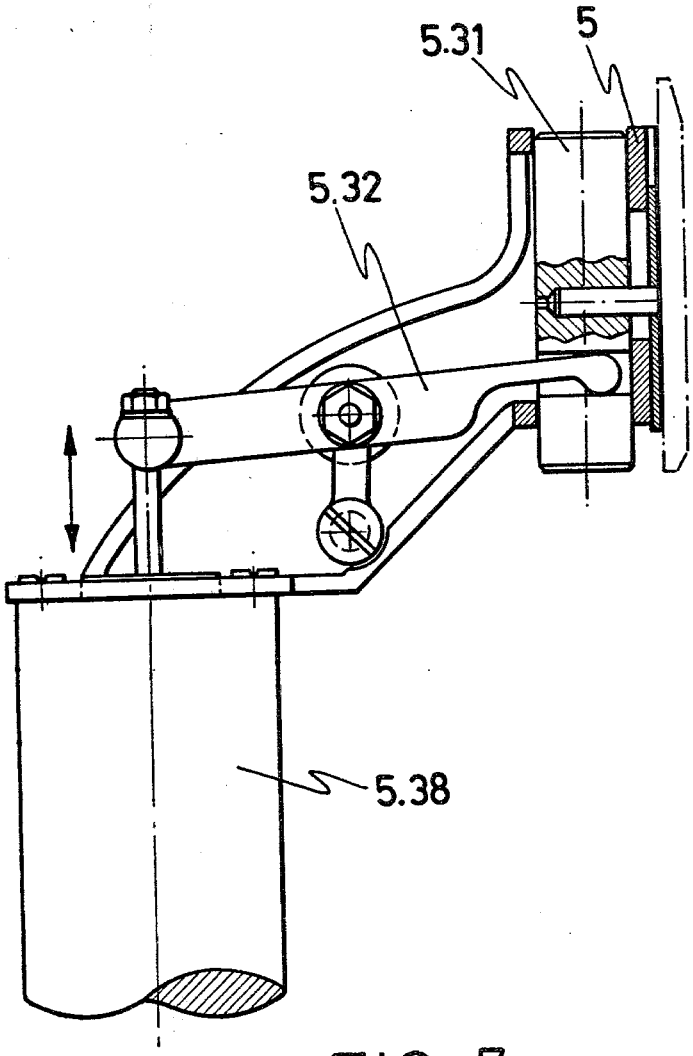
FIG. 7 is an elevation view of a thread cutting device, operable by electromagnetic operation.

As shown in the drawings, the invention provides a novel, substantially simplified thread cutting device applicable to sewing machines that can operate either electro-pneumatically (FIGS. 4, 5 and 6) or electromagnetically (FIG. 7). The thread cutting device can nevertheless be joined to a system for electronic, mechanical, manual, etc. operation.

In any case, the thread cutting device is characterized in that cutting takes place by a unique alternating rectilineal displacement of a member 1 (FIGS. 2 and 3) in directions parallel to the cutting direction of the sewing machine. The rectilineal movement of the mentioned member 1 activates a movable knife 2 through an angular displacement which causes a drag hook 4 to collect the threads, thus ensuring cutting of the threads.

Figure 2:
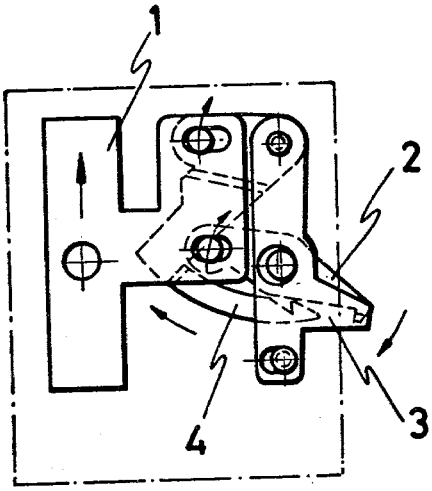
FIG. 2 is a plan view illustrating the elements of the thread cutting device at rest.
Figure 3:
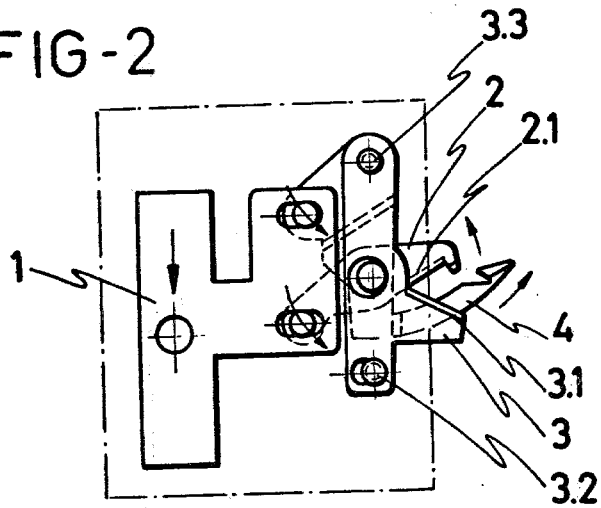
FIG. 3 is a view similar to FIG. 2, but wherein the cutting elements are in a position for collection of the threads and preparation for a subsequent cutting operation.

FIGS. 2 and 3 illustrate the corresponding displacements of the movable elements of the thread cutting device and represent, respectively, the rest position of the cutting elements (movable knife 2 and fixed knife 3), and the maximum outward displacement position of the thread collecting hook 4 and the maximum open position of the movable knife 2 in relation to fixed knife 3. FIG. 3 shows the position moments before the crossing or closing of the corresponding edges 2.1 and 3.1 and, consequently, of the cutting of the threads.

On the other hand, the fixed knife 3 is provided with suitable means 3.2 to allow a slight angular displacement about an axis 3.3, to thus achieve advancing or retarding of the position of the cutting of the thread.

Figure 1:
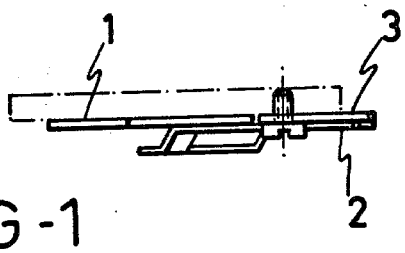
FIG. 1 is a partial elevational view of the novel thread cutting device of the invention.

FIGS. 4, 5 and 6, as previously mentioned, show an electro-pneumatic version of the thread cutting device. Thus, a support 5 is provided with two pneumatic cylinders 5.1 and 5.2, both having a common piston 5.3. Member 1 of the cutting device is activated by means of pin 5.4 for an alternating rectilineal displacement, to achieve cutting in the manner described above. Thus, pin 5.4 operates the member 1 to cause rectilinear movement thereof in opposite directions in the same manner as described above regarding FIGS. 1 through 3. Movement of pin 5.4 is achieved by charging fluid into the cylinders 5.1 and 5.2 to cause piston 5.3 to move therein in opposite directions.

FIG. 7 represents an electromagnetic version of the thread cutting device and differs from the arrangement of FIGS. 4 through 6 only in that the alternating rectilineal operation of member 1 is carried out by means of a cylindrical guide 5.31 which replaces the cylinders 5.1 and 5.2. The cylindrical guide 5.31 is moved by means of arm 5.32 and by members 5.38 (electromagnet) which proportions the corresponding drive impulses. Thus, the pin shown in FIG. 7 achieves opposite rectilinear movement of the member 1 shown in FIGS. 1 through 3 of the drawings, and this is achieved by activation of electromagnet 5.38 to cause arm 5.32 to pivot and thus move cylindrical guide 5.31, thereby moving the pin and the member 1.

In either of the above two mentioned versions, the thread cutting device is incorporated into a sewing machine in correspondence with the position of the common slider plate thereof. For such purpose the slider plate is withdrawn and in its place is positioned a flat element which serves as a support for the component elements of the thread cutting device. Such flat element has, at an end thereof, a bridge 6 wich is pressed against the frame of the sewing machine by action of a screw *7a*.

Figure 9:
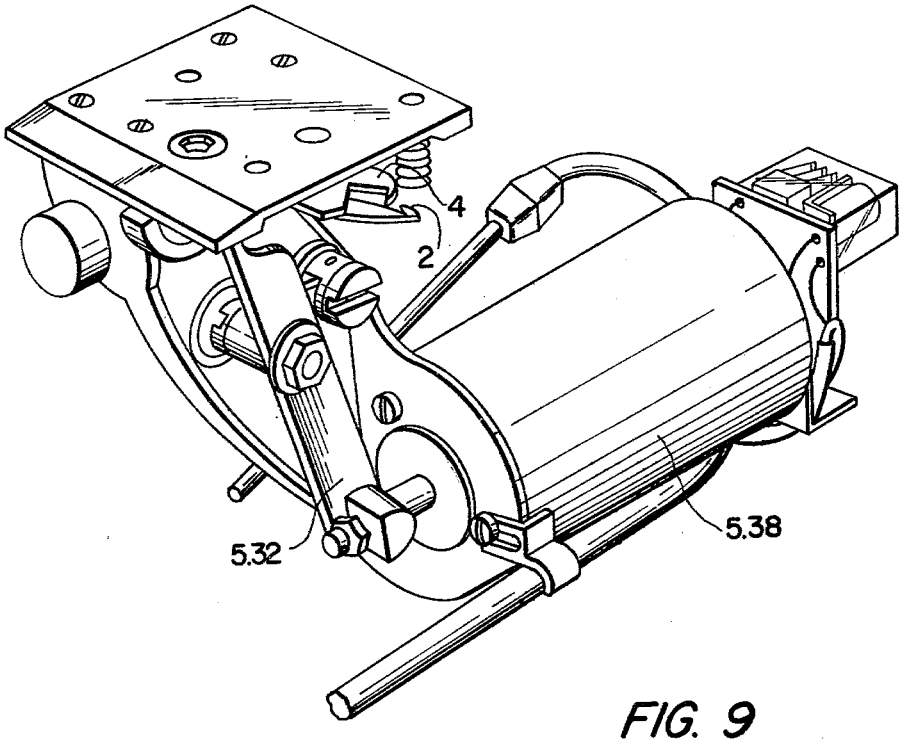
FIG. 9 is a perspective view of the arrangement of FIG. 7 positioned to be mounted on a sewing machine.
Figure 8:
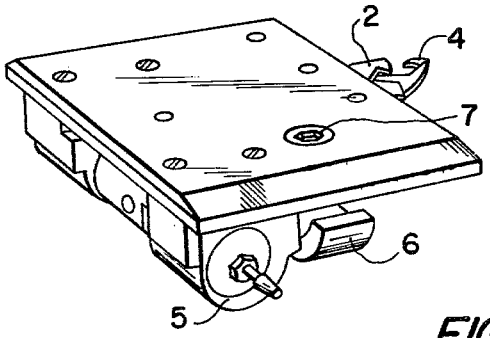
FIG. 8 is a perspective view illustrating the arrangement of FIG. 4 in a position to be mounted on a sewing machine.

FIGS. 8 and 9 illustrate the assembly of the two mentioned versions of the thread cutting device, i.e. the electro-pneumatic (FIG. 8) and electromagnetic (FIG. 9) versions.

Figure 10:
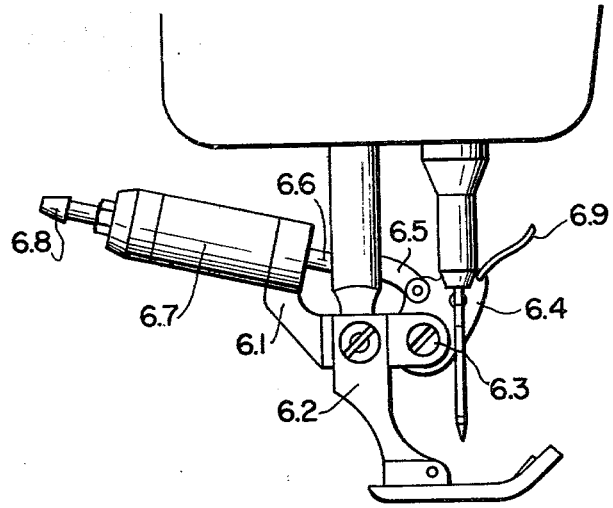
FIG. 10 is an elevation view of a thread withdrawing device according to the present invention in a rest position.
Figure 11:
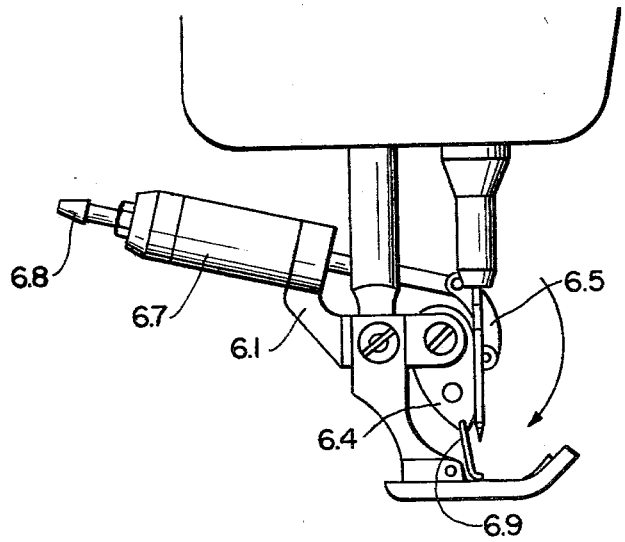
FIG. 11 is a view similar to FIG. 10 but showing the thread withdrawing device in the operative position thereof.

To the described thread cutting device there is incorporated a complementary device, as illustrated in FIGS. 10 and 11. Specifically, FIG. 10 illustrates the assembly of the complementary device mounted on the presser-bar of the sewing machine, with such complementary device being in the normal or rest position thereof. FIG. 11, on the other hand, illustrates the maximum working position adopted by the complementary device to withdraw an upper thread from below the presser-bar, as such upper thread remains after the thread cutting device has operated.

The complementary device is a device which withdraws the thread after the thread cutting operation and comprises a support 6.1 provided with a universal clamp for coupling to the presser-bar 6.2 of the sewing machine. The support 6.1 has at an end thereof a hinge 6.3 for supporting an actuator arm 6.4. Actuator arm 6.4 is also articulated by means of an intermediate lever 6.5 to a rod 6.6 of a cylinder 6.7. Cylinder 6.7 includes a return spring and a feed adapter 6.8 for pneumatic activation. In this way the actuator arm 6.4 is activated by the intermediate lever 6.5 hinged to the rod 6.6 of the cylinder 6.7 when cylinder 6.7 receives a pneumatic impulse, so that a hook 6.9, solidly fastened to the actuator arm 6.4, is moved to its maximum working position (FIG. 11) below the needle and in a condition to withdraw the upper thread from below the presser-bar when the rod 6.6 of the cylinder returns to its rest position by the effect of its return spring, and at the time when the passage of air is interrupted by a corresponding electrovalve of the thread cutting device of FIGS. 1 through 9. Consequently, the cylinder 6.7 operates synchronously with the thread cutting device, and is activated pneumatically with a very short delay with respect thereto, so that the threads will sequentially first be cut and then the upper thread will be withdrawn, whether the presser-bar is raised or lowered.

As can be seen from the corresponding description and illustrations, the mentioned complementary device, that is the device which withdraws the upper thread from below the presser-bar, carries out a complementary function with respect to the thread cutting device. Thus, upon initiating a new sewing operation the ends of both threads (upper and lower) will be situated below the garment, that is on the reverse side of the layer of lower fabric, which detail is of great interest in industrial sewing.

Figures 12, 14:
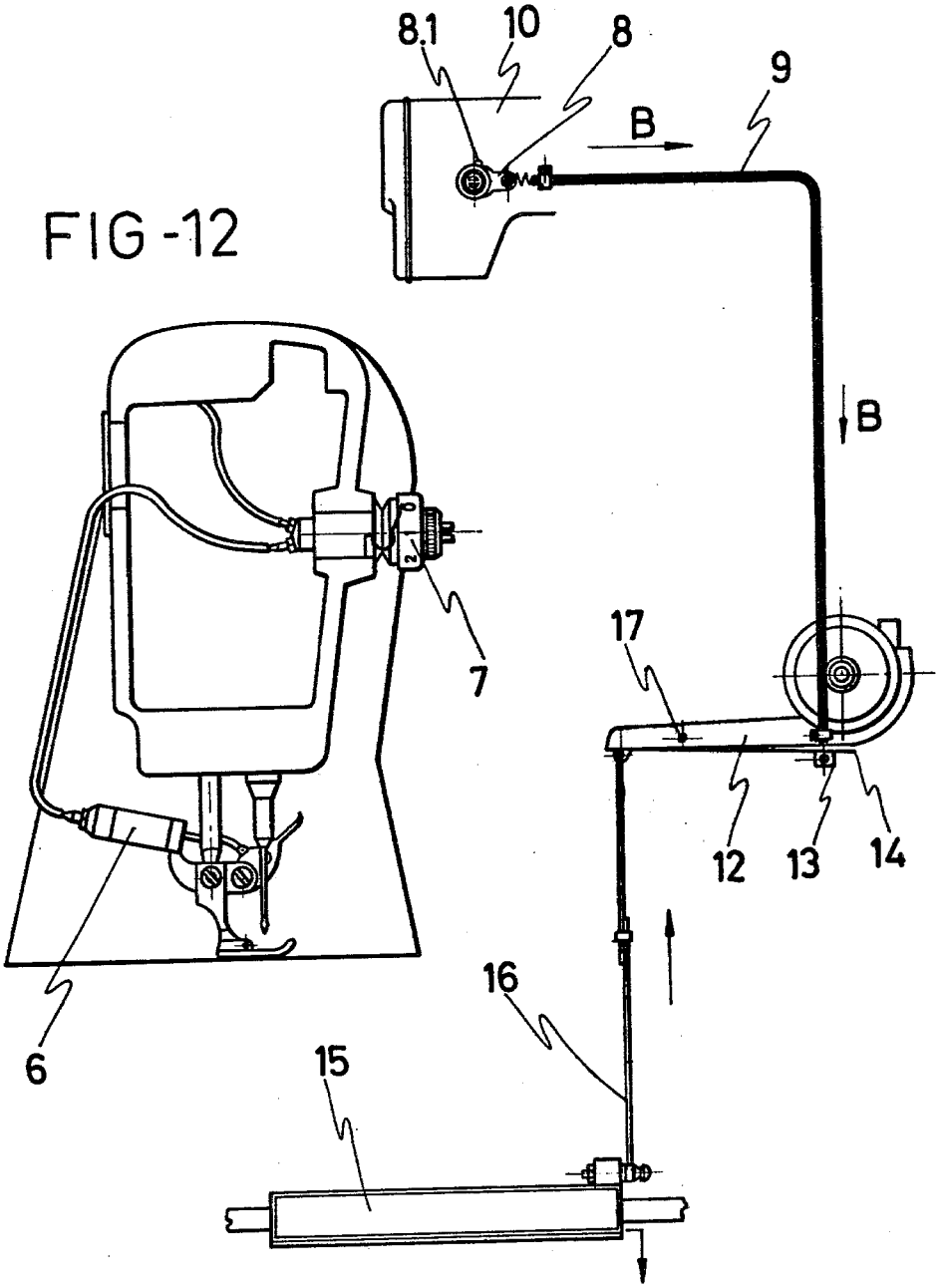
FIG. 12 is an elevation view illustrating the cooperation and synchronization between the thread withdrawing device of the invention and the thread tension releasing device of the invention.
FIG. 14 is a view similar to FIG. 13 but showing the tension releasing device in the operative position thereof.

FIG. 12 illustrates the pneumatic connection between the cylinder 6.7, as the element responsible for operating the thread withdrawing device, and a pneumatic tension device 7.

Also, the thread cutting device operates in functional combination with a device whose only purpose is that of mechanically loosening the tension device 7 of the machine when a pedal 15 is pressed, which pedal is in synchronization with the thread cutting device.

Figure 13:
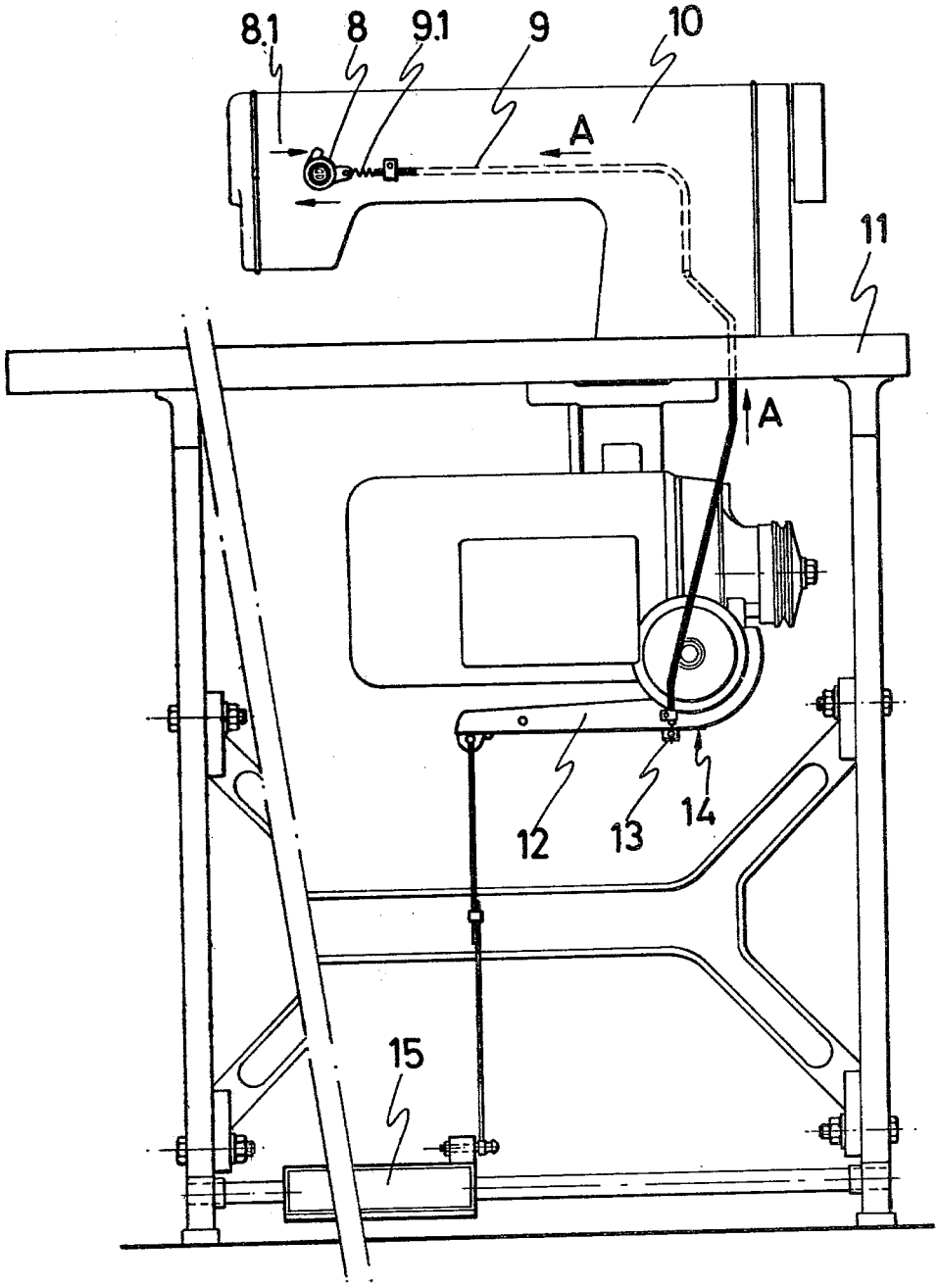
FIG. 13 is an elevation view illustrating the manner of operation of a first embodiment of a tension releasing device of the invention, in the inoperative position thereof.

FIG. 13 illustrates such device, that is that which loosens the tension device of the machine, coupled to the same in its rest position, while FIG. 14 illustrates the working position of the main elements of such device.

Such device includes a plate 8 placed on the shaft of the tension device 7, at a position behind that occupied by the discs of the tension device. Opening of such discs, whereby the tension on the thread is eliminated, is carried out by pulling a cable 9 having a cover which is coupled to the plate 8. The cable 9 is led along the arm 10 of the machine and through a panel 11 to fix the cable cover to a lever 12 of the clutch of the sewing machine motor. A steel center strand of cable 9 is screwed to a member 13 which serves as a guide, which member 13 is solidly fixed to an oscillating arm 14 which constitutes the lever 12 of the clutch of the motor.

At rest, the plate 8, as the opening member of the discs of the tension device, is displaced towards the left in the drawings, so that end 8.1 of the plate is spaced from the discs of the tension device due to a traction spring 9.1 which maintains the center strand of the cable 9 driven in the direction indicated by arrows A in FIG. 13. When the pedal 15 is activated, a tension member 16 pushes the oscillating arm 14 of the lever 12 of the clutch of the motor, whereby the end of arm 14 rises by pivoting about the axis 17. Consequently, the opposite end of arm 14 will be displaced downwardly so that this oscillating movement is transmitted to the center strand of the cable 9 fastened to the guide member 13, thus causing the simultaneous pulling of plate 8, thus overcoming the resistance of spring 9.1. With this pulling, the plate 8 is displaced to the right as shown in the drawings, so that its flange 8.1 is housed between the discs of the tension device, thus achieving opening thereof and, consequently, the releasing of the tension of the thread. The indicated movement is shown by the arrows B in FIG. 14.

Thus, the invention incorporates a tension device for the upper thread in a conventional sewing machine, an opening device for opening such tension device and being operable by mechanical (pedal), electric or electro-pneumatic activation.

Conventional sewing machines are normally provided with an opening mechanism of the tension device, generally manually activated, which acts simultaneously with the raising of the presser-bar and which is for the specific purpose of withdrawing the work from the machine when the upper thread has no tension. The same function is achieved in the present invention at the appropriate moments during a sewing operation with the help of the mechanically, electrically, or electro-pneumatically operated device.

Figure 15:
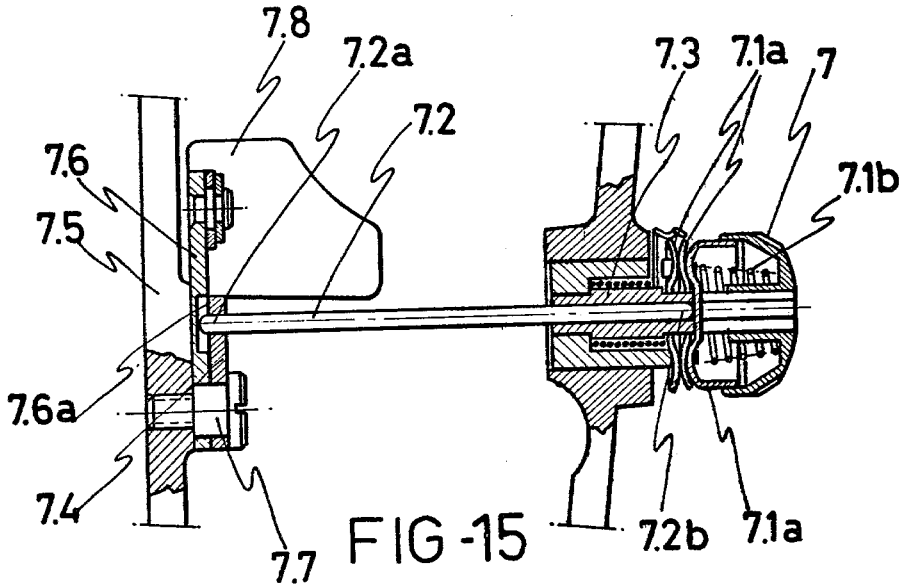
FIG. 15 is a partial section of the internal structure of one embodiment of the tension releasing mechanism of the invention.

FIGS. 15 to 20 illustrate a practical embodiment of this feature of the invention. Specifically, FIG. 15 illustrates the simplest embodiment of a tension device having a known composition. The tension device 7 for the upper thread is provided with a rod 7.2 guided in a shaft 7.3 of the tension device, as well as in a plate 7.4 which is solidly fastened to a head 7.5 of the arm of the sewing machine.

One end 7.2*a* of the rod 7.2 butts against an inclined plane 7.6*a* of a member 7.6 which turns about a pivot screw 7.7. The angular oscillating of the member 7.6 takes place by means of a manually operated lever and a cam (not shown). Both elements simultaneously raise the bar of the presser-bar. Oscillation of element 7.6 can be produced by a tension member 7.8.

Upon such oscillation of element 7.6, the end 7.2*a* undergoes an axial displacement, which, in the raising direction of the presser-bar, causes an axial thrust of the end 7.2*b* of the rod 7.2 against a sleeve 7.1*a* of the tension device in opposition to the expansion strength of a conic spring 7.1*b*, whereby the discs 7.1*a*' of the tension device are not tensioned, and consequently the upper thread, which is between the discs, is also not tensioned.

Figure 16:
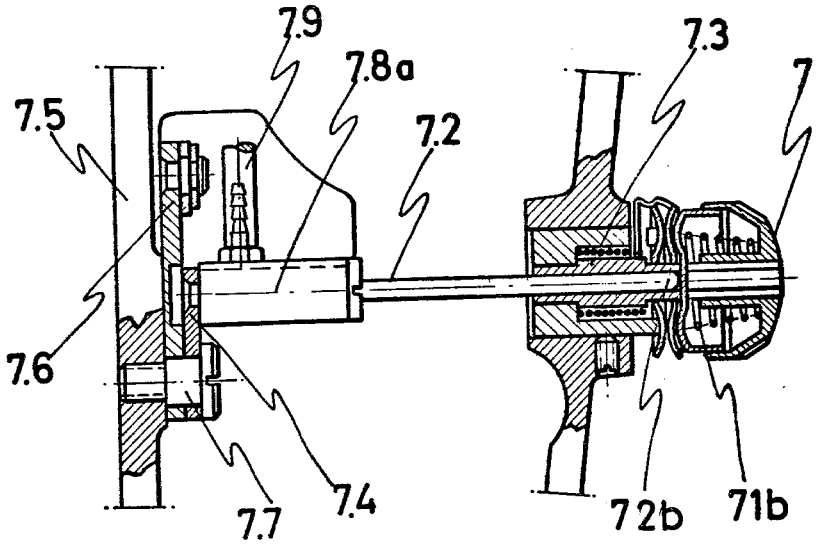
FIG. 16 is a view similar to FIG. 15 but showing a further embodiment of the tension releasing device.

FIG. 16 illustrates an embodiment of the invention similar to the arrangement described with respect to FIG. 15. On the member 7.4 solidly fixed to the arm 7.5 of the machine, there is coupled a pneumatic cylinder 7.8*a* having a feed adapter 7.9 and a piston, not shown, coupled to the end 7.2*a* of the rod 7.2. In this way impulses to trip the discs of the tension device are produced by pneumatic means at a desired controlled moment. Similar results may be obtained by replacing the cylinder 7.8*a* with an electromagnet.

Figure 17:
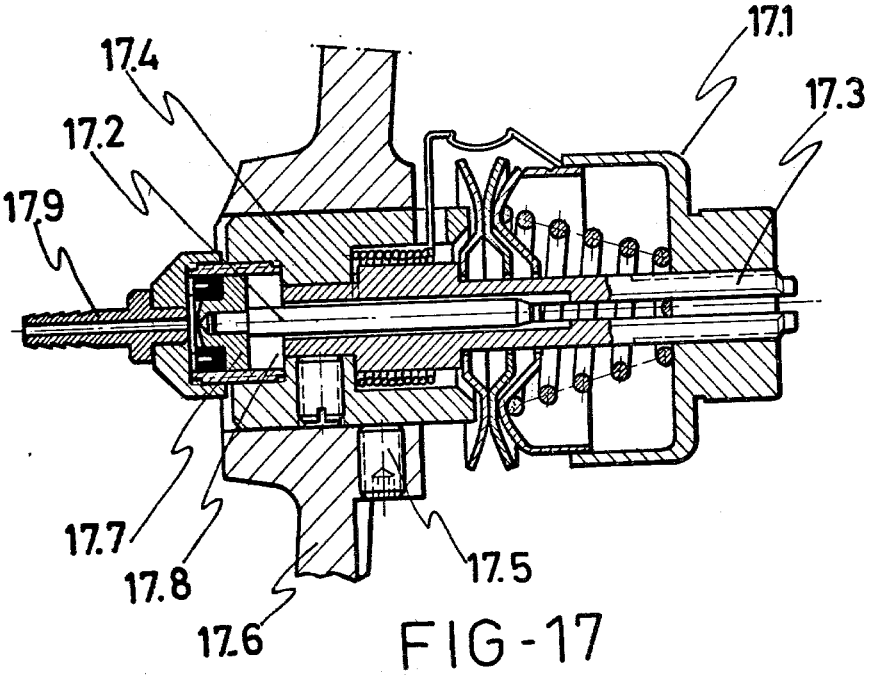
Figure 18:
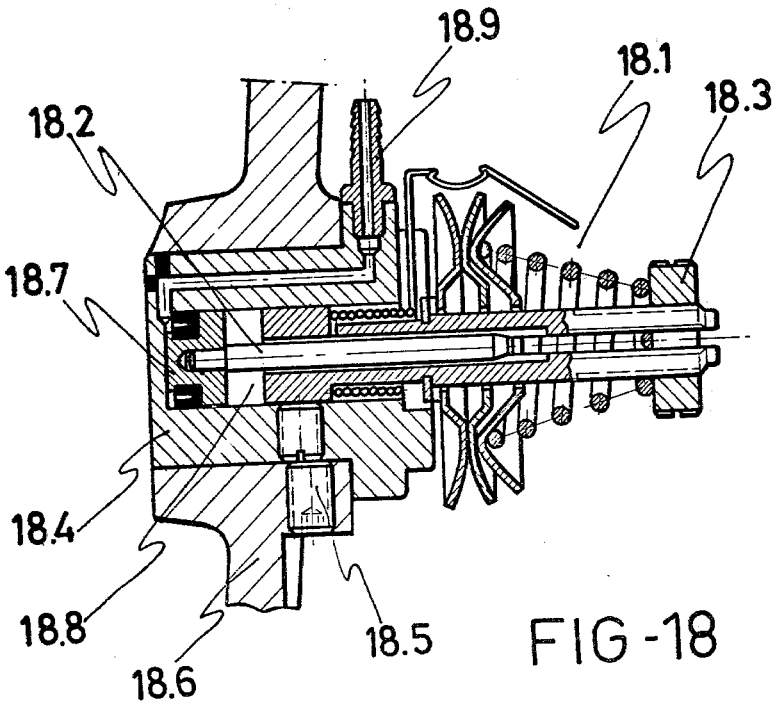

FIGS. 17 and 18 illustrate two more constructional variants of the thread tension device. Both embodiments correspond, in known parts, to two types of upper thread tension devices commonly used at the present time in sewing machines, but modified to incorporate the novel features of the present invention.

Thus, the thread tension devices of known composition 17.1 and 18.1 are provided with rods 17.2 and 18.2 guided in shafts 17.3 and 18.3 of the tension devices mounted in turn on sleeves 17.4 and 18.4 which are solidly fastened to frames 17.6 and 18.6 of the sewing machines by means of tightening screws 17.5 and 18.5, respectively shown in FIGS. 17 and 18.

In the sleeves 17.4 and 18.4, respectively, there are provided cylindrical cavities 17.8 and 18.8 to function as the bodies of pneumatic cylinders in which pistons 17.7 and 18.7, coupled to rods 17.2 and 18.2, slide. There are provided feed adapters 17.9 and 18.9 for the pneumatic activation of the tension devices.

Figure 20:
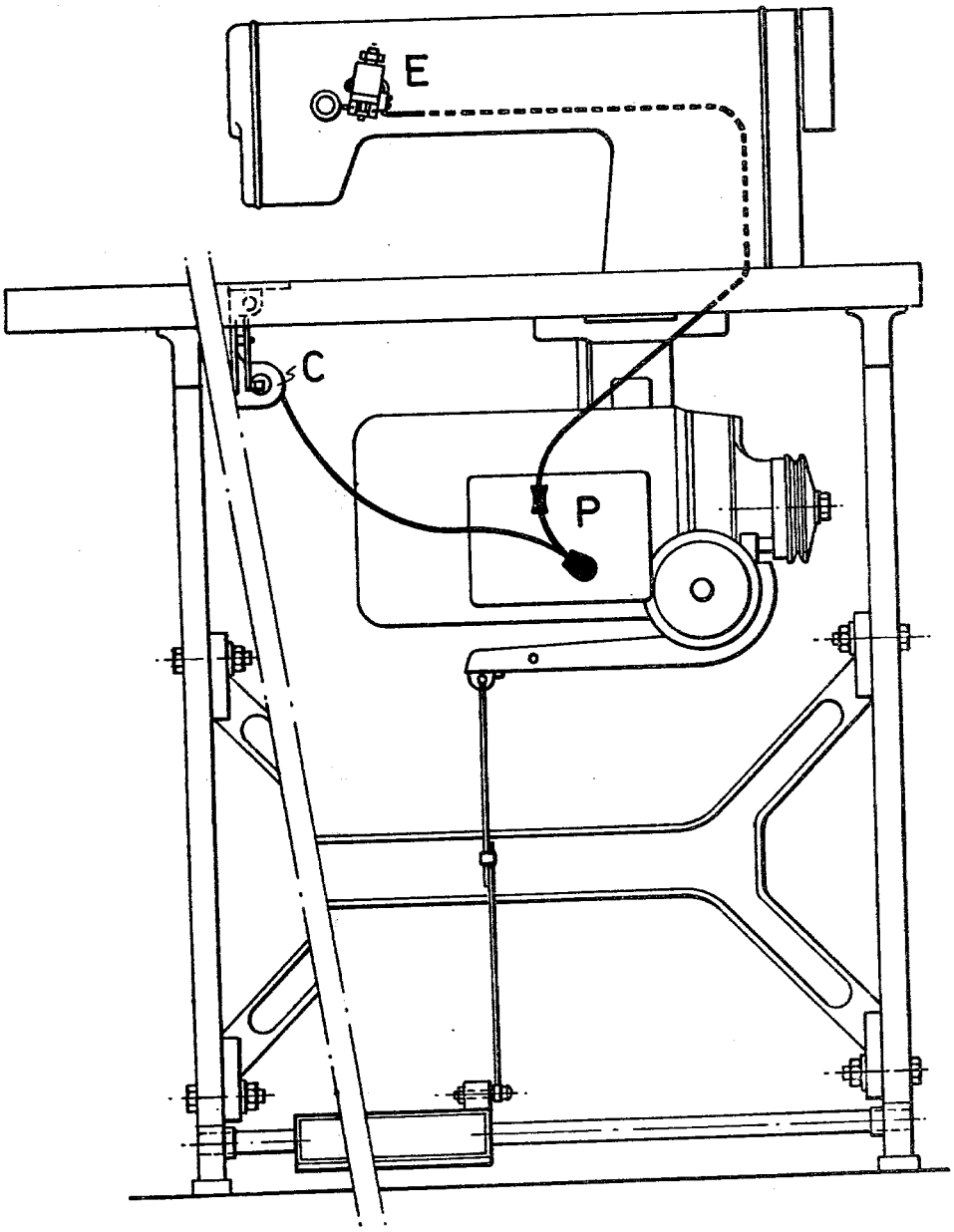
FIG. 20 is an elevation view illustrating the cooperation between the tension releasing device of FIG. 19 and the thread cutting device of the invention.

FIG. 19 illustrates another embodiment of the thread tension device, but provided with means for electromagnetic activation. Specifically, one end of rod 19 is connected to a bent plate 20 which is activated by an electromagnet. With the modifications introduced, the opening of the discs of the tension device is carried out by an electromagnet E, as shown in FIG. 20. Such electromagnet is placed on a support base in the header of the sewing machine and is connected to the corresponding thread cutting device C and the control panel P of the positioning motor. FIGS. 20*a* and 20*b* illustrate the composition of the electromagnet E of FIG. 20 which activates bent plate 20 and rod 19.

The various described and illustrated arrangements all provide for modification of a thread tension device by another device which is activated mechanically, electro-pneumatically or electromagnetically and whose function is synchronized with other mechanisms inherent or incorporated in the sewing machine, such as for example the described thread cutting device.

Due to the growing increase of mass production in industry, the need to decrease the price of a ready-made product, whose selling price is greatly influenced by the costs of hand labor involved in the manufacture thereof, is increasingly important. Thus, the adaptation of devices leading to the automation of sewing machines is of extraordinary interest.

The present invention harmonizes and synchronizes various elements to achieve such ends. These elements are the sewing machines themselves provided with thread cutting devices and complementary devices, such as the upper thread withdrawing device and the thread tension activating device. An electro-pneumatic control synchronizes the action of such devices.

I claim:

1. A system for achieving automatic synchronized thread cutting during a sewing operation on a sewing machine, said system comprising, in combination:

a thread cutting device adapted to be mounted on a sewing machine, said thread cutting device comprising:

a support plate adapted to be mounted on a sewing machine in place of common sliding elements thereof;

a fixed knife fixedly mounted on said support plate;

a member supported by said support plate for movement in first and second opposite rectilinear directions extending parallel to a direction of sewing of the sewing machine;

a movable knife pivoted to said member and to said fixed knife for pivoting movement with respect thereto between an open first position spaced from said fixed knife and a cutting second position against said fixed knife;

a thread collecting hook pivoted to said member for pivoting movement with respect thereto between a first position between said fixed and movable knives when said movable knife is in said open first position thereof, whereat said hook is positioned to gather a thread to be cut, and a second position adjacent said fixed knife when said movable knife is in said cutting second position thereof, whereat said hook positions a thread to be cut between said knives; and actuating means, connected to said member, for moving said member in said first rectilinear direction, and thereby pivoting said movable knife and said hook to said respective first positions thereof, and for moving said member in said second rectilinear direction, and thereby pivoting said movable knife and said hook to said respective second positions thereof;

thread withdrawing means, adapted to be mounted on a presser-bar of the sewing machine, and operatively connected to said actuating means, for withdrawing a thread cut by said thread cutting device from beneath the presser-bar; and thread tension releasing means, operatively connected to said actuating means, and adapted to be incorporated into a thread tensioning device of the sewing machine, for releasing tension on a thread which has been cut by said thread cutting device.

2. A system as claimed in claim 1, wherein said fixed knife is mounted on said support plate for slight angular displacement about an axis, to thereby adjust the relative position of said fixed knife with respect to said movable knife, and to thus advance or retard the relative position of cutting of the thread.

3. A system as claimed in claim 1, wherein said actuating means comprises a pair of fluid cylinder chambers having therein a common piston, and a pin extending from said piston and connected to said member.

4. A system as claimed in claim 1, wherein said actuating means comprises an arm pivotally mounted about an axis substantially at the center thereof, an electromagnet connected to a first end of said arm for pivoting said arm about said axis, a cylindrical guide connected to a second end of said arm for longitudinal movement thereby, and a pin extending from said guide and connected to said member.

5. A system as claimed in claim 1, wherein said thread withdrawing means comprises a support adapted to be clamped to the presser-bar, an actuator arm pivoted to said support, a fluid cylinder fixed to said support, said cylinder having a piston rod, a lever pivoted to said piston rod and to said actuator arm, and a thread contacting and withdrawing hook fixed to said actuator arm, whereby movement of said piston rod in a first direction causes pivoting movement of said actuator arm and said hook about said support to a first position below a needle of the sewing machine.

6. A system as claimed in claim 5, wherein said cylinder includes spring means for causing said piston rod to move in a second direction opposite to said first direction and to thereby pivot said actuator arm and said hook about said support to a second position above the needle.

7. A system as claimed in claim 1, wherein the tension device of the sewing machine is of the type including a pair of discs positioned about an axis, and means for moving said discs together to grasp therebetween the thread to thus tension the thread, and wherein said thread tension releasing means comprises means for moving said discs apart from each other to thereby release the grasp of the thread.

8. A system as claimed in claim 7, wherein said means for moving said discs comprises a plate rotatably mounted about said axis of said discs, said plate having extending therefrom an appendix, cable means connected to said plate for rotating said plate in a first direction about said axis to a position such that said appendix extends between and separates said discs, and spring means connected to said plate and said cable means for rotating said plate in a second opposite direction about said axis to a position such that said appendix is withdrawn from between said discs.

9. A system as claimed in claim 7, wherein said means for moving said discs comprises a rod extending through said axis, spring means for urging a sleeve against a first end of said rod and against said discs, and means acting on a second end of said rod for pushing said rod axially against said sleeve and moving said sleeve against the force of said spring means.

10. A system as claimed in claim 9, wherein said acting means comprises a member having an inclined plane abutting said second end of said rod, and means for oscillating said member such that said inclined plane pushes on said second end of said rod.

11. A system as claimed in claim 9, wherein said acting means comprises a fluid cylinder having a piston rod connected to said second end of said rod.

12. A system as claimed in claim 9, wherein said acting means comprises a bent plate connected to said second end of said rod, and an electromagnet operatively connected to said bent plate for moving said bent plate axially.

13. A system as claimed in claim 9, wherein said acting means comprises a sleeve surrounding said rod, said sleeve having therein a cavity forming a cylinder chamber, a piston within said chamber and connected to said second end of said rod, and means for supplying fluid to said chamber for moving said piston and said rod axially.

14. A thread cutting device adapted to be mounted on a sewing machine, said thread cutting device comprising:

a support plate adapted to be mounted on a sewing machine in place of common sliding elements thereof;

a fixed knife fixedly mounted on said support plate;

a member supported by said support plate for movement in first and second opposite rectilinear directions extending parallel to a direction of sewing of the sewing machine;

a movable knife pivoted to said member and to said fixed knife for pivoting movement with respect thereto between an open first position spaced from said fixed knife and a cutting second position against said fixed knife;

a thread collecting hook pivoted to said member for pivoting movement with respect thereto between a first position between said fixed and movable knives when said movable knife is in said open first position thereof, whereat said hook is positioned to gather a thread to be cut, and a second position adjacent said fixed knife when said movable knife is in said cutting second position thereof, whereat said hook positions a thread to be cut between said knives; and actuating means, connected to said member, for moving said member in said first rectilinear direction, and thereby pivoting said movable knife and said hook to said respective first positions thereof, and for moving said member in said second rectilinear direction, and thereby pivoting said movable knife and said hook to said respective second positions thereof.

15. A device as claimed in claim 14, wherein said fixed knife is mounted on said support plate for slight angular displacement about an axis, to thereby adjust the relative position of said fixed knife with respect to said movable knife, and to thus advance or retard the relative position of cutting of the thread.

16. A device as claimed in claim 14, wherein said actuating means comprises a pair of fluid cylinder chambers having therein a common piston, and a pin extending from said piston and connected to said member.

17. A device as claimed in claim 14, wherein said actuating means comprises an arm pivotally mounted about an axis substantially at the center thereof, an electromagnet connected to a first end of said arm for pivoting said arm about said axis, a cylindrical guide connected to a second end of said arm for longitudinal movement thereby, and a pin extending from said guide and connected to said member.

* * * * *